United States Patent [19]

Cobb

[11] 4,311,347

[45] Jan. 19, 1982

[54] DRILL STEEL GUIDE

[75] Inventor: William R. Cobb, Murrysville, Pa.

[73] Assignee: Schroeder Brothers Corporation, McKees Rocks, Pa.

[21] Appl. No.: 83,377

[22] Filed: Oct. 10, 1979

[51] Int. Cl.[3] ..... F16C 31/00

[52] U.S. Cl. ..... 308/3.9; 173/23; 173/44; 175/220

[58] Field of Search ..... 308/3.9, 3 R, 3 A; 175/220; 173/44, 22, 39, 149, 23

[56] References Cited

U.S. PATENT DOCUMENTS

| | | | |
|---|---|---|---|
| 2,734,723 | 2/1956 | Larcen | 308/3.9 X |
| 2,828,109 | 3/1958 | Dellner | 308/3.9 |
| 3,827,508 | 8/1974 | Mackinnon | 173/112 |
| 4,076,337 | 2/1978 | Childress | 175/220 X |

FOREIGN PATENT DOCUMENTS

| | | | |
|---|---|---|---|
| 702857 | 1/1954 | United Kingdom | 308/3.9 |

*Primary Examiner*—Dennis L. Taylor

*Attorney, Agent, or Firm*—Webb, Burden, Robinson & Webb

[57] ABSTRACT

A drill steel guide or clamp for use with mine roof drilling and bolting machines which guides and clamps the drill steel relative to a standard but which can be kicked out of the way by the advancing drill pod after which time the guide is no longer required for the particular bolt hole being drilled. The clamped guide comprises a clevis body pivotally secured to the standard having two retaining arms individually pivotally mounted to the clevis for rotation into clamping and guiding relation with the drill steel. A unique palm lock comprises extensions for embracing the retaining arms to prevent rotation of the arms out of guiding relationship with the drill steel. The palm lock is arranged to be unlatched when struck by the drill pod or kick plate attached thereto as the drill pod pushes the guide out of the way as it advances.

4 Claims, 11 Drawing Figures

DRILL STEEL GUIDE

BACKGROUND

This invention relates to a roof drilling and bolting device for use in placing roof bolts in the roof of mine passageways. In particular, it relates to a roof drilling and bolting device of the type described in our U.S. Pat Application Ser. No. 030,219 filed Apr. 16, 1979 entitled "Roof Bolting Device." In particular, this invention relates to a drill guide for supporting the drill steel as it is started into the mine roof and moved therein. In the apparatus according to our above referenced patent application, the drill steel is inserted in the chuck of a drill pod, which is a hydraulic motor for turning the drill steel, and the drill pod is moved vertically upward along a generally vertical track. The track is mounted on or comprises part of a generally vertical tower. The tower itself is arranged for movement over a horizontal rail thus resulting in rectilinear positioning of the drill pod.

It is an advantage of this invention to provide a drill steel guide mounted near the top of the tower, which guide can be kicked out of the path of the drill pod as it is raised past the vertical position where the guide is mounted. It is a further advantage that the coal dust ever present in the environment in which the drill steel guide is mounted will not accumulate and clog the workings of the guide.

Briefly according to this invention, there is provided a drill steel guide for mine roof drilling and bolting machines of the type in which a drill pod is raised and lowered along a generally vertical track. The drill steel guide is mounted relative to the vertical track spaced from the downwardmost position of the drill pod. Typically the drill steel guide is mounted near the top of the tower which guides the vertical track which in turn guides the vertical movement of the drill pod. In any event, the drill guide is mounted at a location downward from the upwardmost travel of the drill pod. The drill steel guide according to this invention comprises a main shaft mounted on a generally horizontal axis relative to the vertical track. Pivotally mounted to the main shaft is a clevis body. The clevis body is swingable from a generally horizontal to a generally vertical position upon the main shaft. A stop fixed relative to the shaft limits the downward swing of the clevis body at the generally horizontal position. A spring latch holds the clevis body in its generally vertical position until it is pulled down by hand pressure. The spring latch comprises a spring biased plunger which is guided by a bore in the clevis body and bears upon a cam surface on the main shaft.

Two retaining arms are pivotally mounted to said clevis body on separate axles fixed in the clevis body which axles are perpendicular to the main shaft and generally parallel to the drill steel when the clevis body is resting on the stop. The retaining arms together define a drill steel guide passage for receiving and guiding the drill steel. Springs secured to the clevis body bias the retaining arms together. To lock the retaining arms about the drill steel in their drill steel guiding position, there is provided a palm lock which comprises a shaft journaled in the clevis body in bores having an axis parallel to the retaining arm axles. The palm lock carries extensions for embracing the retaining arms. In one position, the palm lock carries the extensions into the embracing position locking the retaining arms against rotation away from the drill steel. In another position, the palm lock carries the extensions free of and away from the retaining arms. A spring plunger mounted in the clevis body latches the palm lock so that in either of its positions, it does not tend to drift toward the other position. An extension of the palm lock shaft is arranged to be aligned with a kick plate or the like attached to the drill pod such that as the drill pod approaches the guide, the kick plate moves the palm lock to its nonlocking position. This enables the retaining arms to be spread and therefore the drill pod can kick the entire clevis body out of its path of travel.

THE DRAWINGS

FIG. 1 is a side view of a rectilinear drilling apparatus showing the drill guide in its guide position and in its "kicked-out" position, the later shown in phantom, FIG. 2 is a top view in detail of the assembled drill guide according to this invention, FIG. 3 is a side view in detail of the assembled drill guide according to this invention, FIGS. 4 and 5 are top and side views respectively of the shaft anchor and stop according to this invention, FIGS. 6 and 7 are top and side views respectively of the clevis body according to this invention, FIGS. 8 and 9 are partial top and side views respectively of the left and right retaining arms, according to this invention, and FIGS. 10 and 11 are bottom and side section views respectively of the palm lock according to this invention.

DESCRIPTION OF THE PREFERRED EMBODIMENTS

Figure 1:
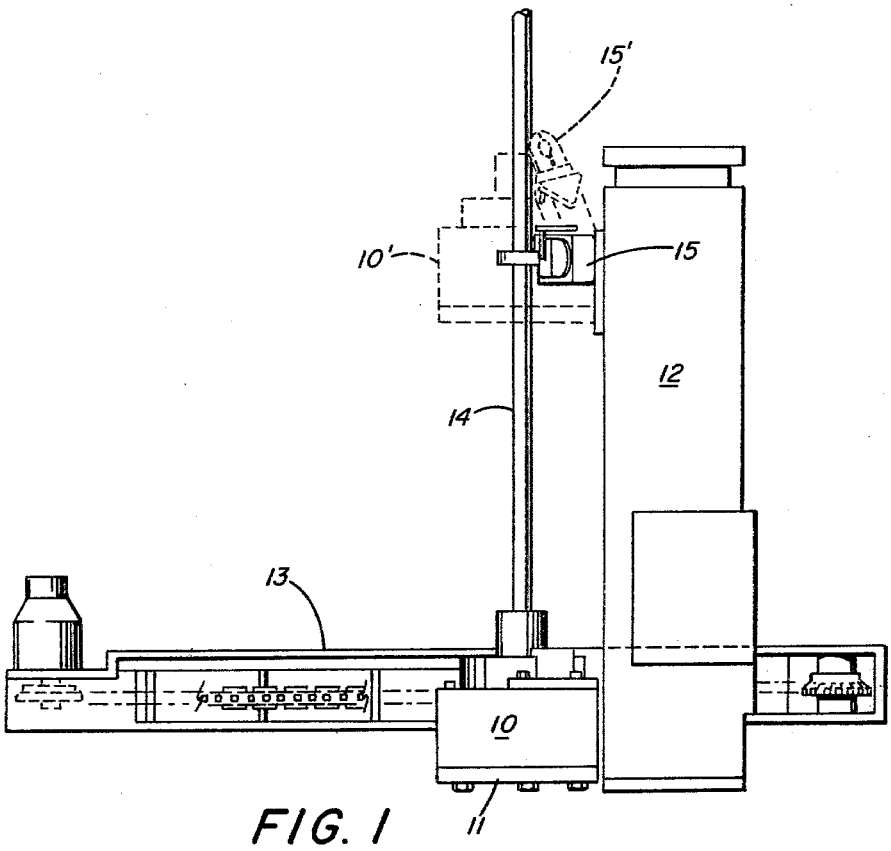

Referring now to FIG. 1, there is illustrated the basic elements of a pod positioning device. The drill pod is carried by a carriage 11 slidably connected to a track mounted on tower 12. Thus the drill pod may be raised and lowered along the length of the tower 12. If the tower is similar to apparatus described in our United States Patent Application Ser. No. 030,221, filed Apr. 16, 1977 entitled "Rectilinear Positioning Device for Drilling Pod", then the pod 10 can actually be raised above the top of the tower 12. In that application, a drill steel guide mounted on top of a track that rises within the tower is described. A drawback of that arrangement is that the overall height of the tower is increased by the space taken up by the drill guide. This in turn restricts the height to which the drill pod may be raised. Also shown in FIG. 1, is the horizontal track 13 on which the vertical tower is carried. The drill steel 14 is shown extending upward from the drill pod. The location of a drill guide 15 as disclosed herein is shown in the drill steel embracing and supporting position. The drill pod 10' in a raised position is shown with phantom lines and the drill guide 15' in the "kicked-out" position is also shown in phantom lines.

Figure 4:
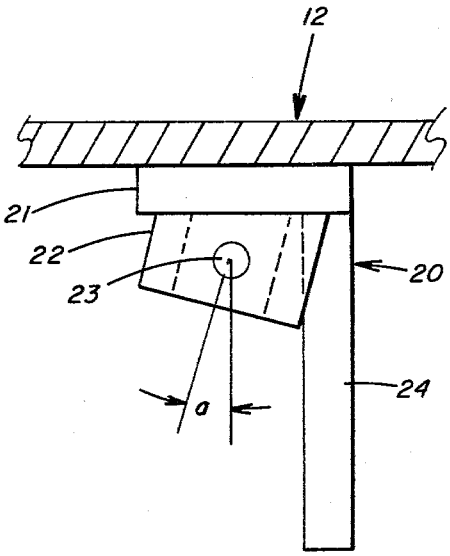
Figure 5:
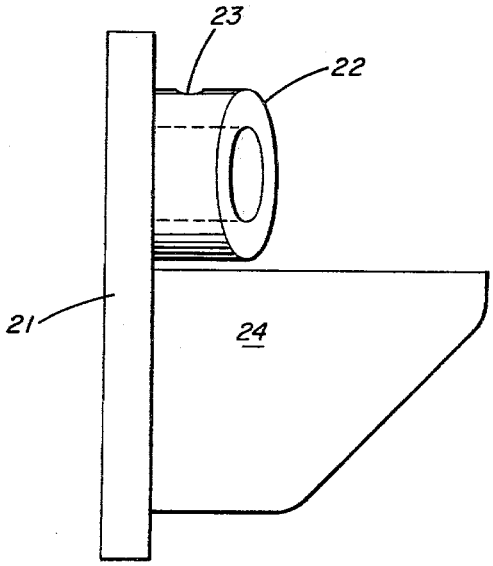

Referring now to FIGS. 4 and 5, the shaft anchor 20 comprises a base 21 which can be secured to the tower-wall 12 and a tubular shaft boss 22 mounted to the base 21. The axis of the tubular shaft boss 22 lies, generally speaking, in a plane parallel to the horizontal when the base 21 is attached to the tower 12. The axis of the shaft boss 22 forms a small angle $\alpha$, say 10 to 30 degrees, with a line normal to the plane of the base 21. A small radial bore 23 is provided in the boss to receive a pin when the shaft (see FIG. 2) has been inserted within the inner diameter of the tubular shaft boss. Thus when the shaft and the pin are in place, the shaft cannot rotate upon its axis. Also attached to the base 21 is stop gusset 24.

Figure 6:
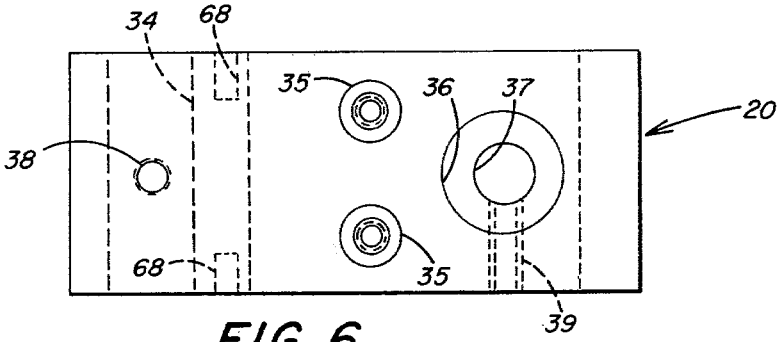
Figure 7:
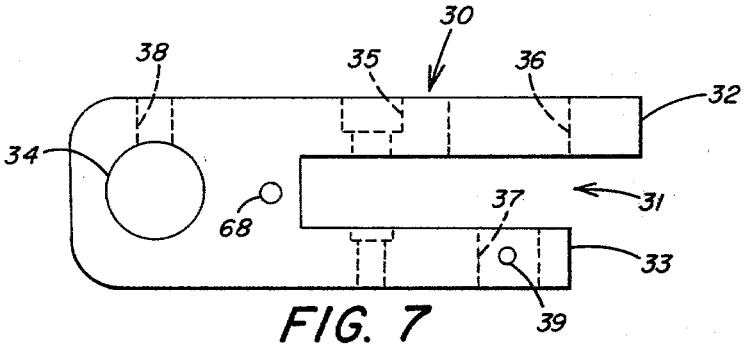

Referring now to FIGS. 6 and 7, the clevis body 30 comprises a forked shaped block divided at one end by a recess 31 into upper 32 and lower 33 planar extensions. The lower planar extension is shorter than the upper extension. The lower extension is also slotted clear through in the longitudinal direction. This facilitates the removal of dust which may accumulate between the extensions. A hinge bore 34 passes through the clevis body near the unforked end. The axis of the hinge bore lies along a plane the extension of which passes through the recess 31. In other words, when the clevis body is pivotally fixed to a shaft passing through the bore 34 and into the tubular shaft boss 22, the clevis body swings up and down about a generally horizontal axis (the axis of the shaft) and the planar extensions of the clevis body may thus be rotated into a generally horizontal position. In fact, the stop 24 is arranged to stop the downward swing of the clevis body with the planar extensions in a generally horizontal position. Three bores pass through the planar extensions 32 and 33 along generally vertical axes (when the body is resting on a stop 24). Bores 35 have portions in both the upper and lower extensions 32 and 33. These bores are designed to receive shoulder bolts and thus the lower portions of the bores in the lower planar extension 33 are threaded. The retaining arms 41, 42 generally laying within the recess 31 are respectively pivotally mounted to the shoulder portion of the shoulder bolts 63 (see FIG. 2). The retaining arms are described hereafter with reference to FIGS. 8 and 9. A large bore 36 in the upper planar extension 32 is coaxial with the smaller bore 37 in the lower planar extension 33. These bores are arranged to receive the palm lock 55 described hereafter with reference to FIGS. 10 and 11.

A generally vertically threaded bore 38 passes from the top surface of the clevis body into the body and has an axis intersecting the axis of the hinge bore 34. The bore 38 is for receiving a biased plunger explained hereafter. A threaded bore 39 passes through the lower planar extension 33 and has an axis intersecting the axis of the small vertical bore 37. Bore 39 is for receiving a spring plunger described hereafter.

Figure 8:
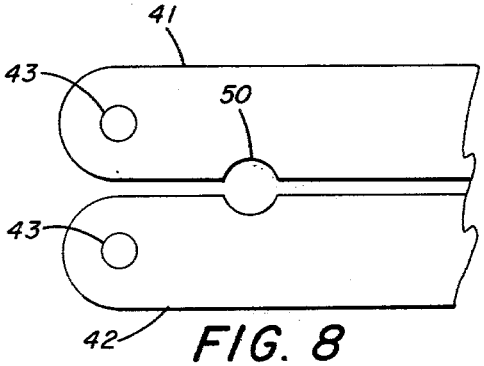
Figure 9:
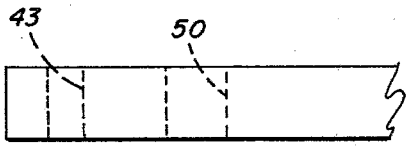

Referring now to FIGS. 8 and 9, a top view of the left retaining arm 41 and the right retaining arm 42, the retaining arms have journaled bores 43 for receiving shoulder bolts 63 when the retaining arms are sandwiched between the planar extensions 32 and 33 of the clevis body. Note that the edge surface of the retaining arms near the journal bores is generally hemicylindrical with the axis of the cylindrical edge surface coaxial with the axis of the journal bores. This cylindrical shape of the ends of the retaining arms enables them to rotate about the shoulder bolts without interference from the clevis body. The retaining arms 41 and 42 define a cylindrical space through which the drill steel passes when they are rotated together (shown in FIG. 2). Together the retaining arms 41 and 42 define a bore 50 parallel to the journal bores 43 for receiving the palm lock.

Figure 10:
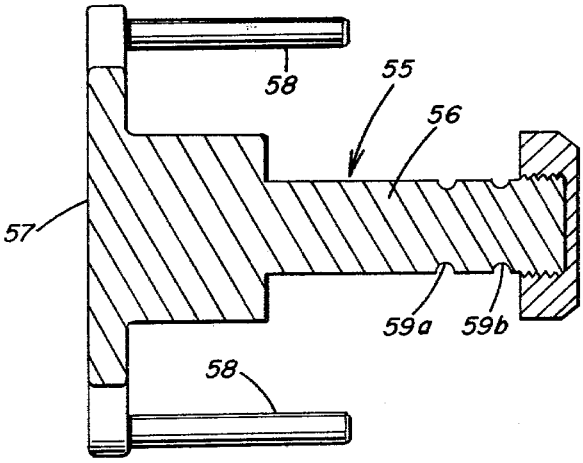
Figure 11:
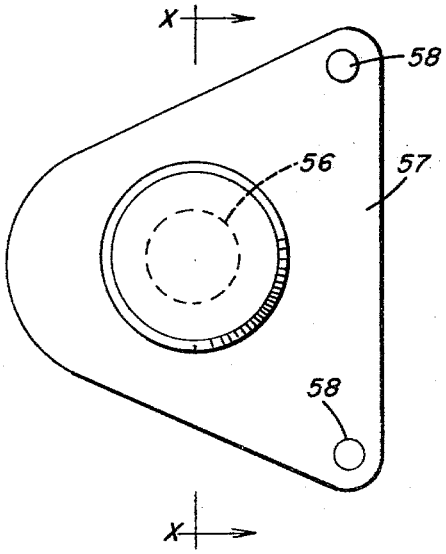

Referring now to FIGS. 10 and 11, the palm lock 55 comprises a guide shaft 56 comprising a smaller diameter portion and a larger diameter portion, a palm plate 57 and two extensions 58 from the palm plate for embracing the outer edges of the retaining arms to prevent the outward rotation thereof when the palm plate is in a downwardmost position. Threaded to the bottom end of the guide shaft is a striker pad (shown in FIG. 10 only) which provides a large contact surface to be struck by the kick plate mounted to the drill pod. It also prevents the palm lock from being driven entirely out of the clevis body on hard contact with the kick plate. Near the end of the guide shaft 56 away from the key 58 are two annular retaining grooves 59*a* and 59*b*.

Figure 2:
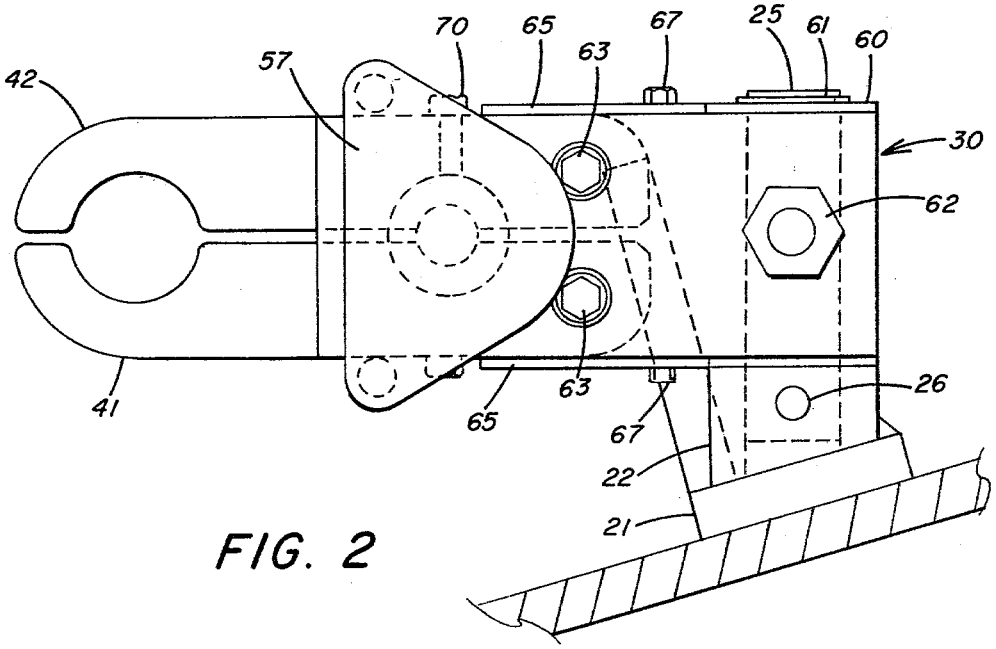
Figure 3:
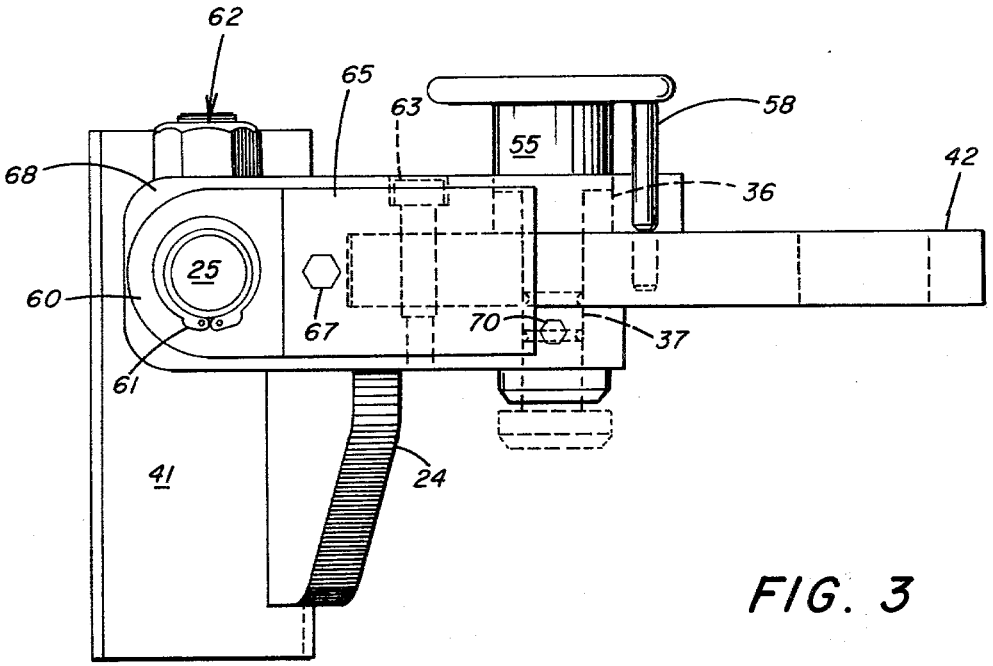

Up to this point, the details of the major elements of the drill steel guide according to this invention have been described. With reference to FIGS. 2 and 3, the assembled combination will now be described. The base 21 supports the tubular shaft boss 22 and the shaft 25 extends out of the boss. Pin 26 passes through the bore 23 in the tubular shaft boss 22 and a radial bore in the shaft to prevent rotation of the shaft 25 within the tubular shaft boss 22. The pin also prevents axial movement of the shaft within the shaft boss. Rotation of the shaft relative to the shaft boss must be prevented so that a cam surface grooved in the cylindrical surface of the shaft will be properly oriented. The groove surface or cam surface cooperates with a spring plunger in the clevis body to latch the clevis body in a vertical position when it is rotated thereto.

The clevis body 30 is pivotally mounted upon the shaft 25 and is held in place between washer 60 by retaining ring 61. The downward swing of the clevis body is restricted by the stop gusset 24 secured to the base.

A biased plunger assembly 62 is threadably secured in a threaded bore 38. A heavy end pressure spring biased plunger is forced against the surface of the shaft 25. An annular camway (not shown) grooved in the surface of the shaft 25 receives the plunger. Thus, when the clevis body is rotated upward to a vertical position, it is latched upward. The latching action of the biased plunger 62 and the camway in the surface of the shaft can be overcome by hand pressure of the drill operator but not by the normal bumps and vibrations of the drilling apparatus. Hence, when the drill pod kicks the drill steel guide away in passing upward, the drill guide remains upward out of the path of the drill pod so that it can freely return downward past the position of the drill guide.

The left and right 41 and 42 retaining arms are shown pivotally secured by shoulder bolts 63 passing through journal bores 43. Retaining arms rotate toward and away from each other with the pivot points being the shoulder bolts 63.

The opposed retaining arms and guide inserts are biased toward each other by leaf springs 65 held to the clevis body by bolts 67 turned into threaded bores 68.

Palm lock 55 is shown in FIGS. 2 and 3 with the small diameter portion of the guide shaft slidably journaled in the bore 37 in the lower planar extension 33 and the larger diameter portion of the palm lock slidably journaled in the bore 36 in the upper planar extension 32. As shown in FIG. 3, the palm lock is in its raised position in which the extensions 58 do not embrace the retaining arms. To latch the palm lock in the raised position, a spring plunger assembly 70 is held in place by a bolt that turns into threaded bore 39 on the lower extension of the clevis body. The plunger rests in the annular groove 59*b* preventing the palm lock from drifting into the locking position. With hand pressure, the palm lock can be advanced to the locking position with the extensions 58 embracing the retaining arms. The spring plunger assembly latches the palm lock in the locked position by entering groove 59*a*.

OPERATION

The above described drill guide is assumed to be at its vertical latched position and the drill pod at its lowermost position to begin with. The drill steel 14 is placed in the chuck of the drill pod and with hand pressure the guide is pulled toward the drill steel. Only hand pressure is required to overcome the latch holding the drill guide in its vertical position. As the drill guide rotates toward the drill steel, the inserts strike the drill steel and spread apart so that the guide can rotate to its horizontal position with the inserts embracing the drill steel. At that time, the operator strikes the palm plate forcing the palm lock into its locking position wherein it is latched by the spring plunger. In this position, the extensions 58 embrace the retaining arms 41, 42 preventing outward rotation thereof. As the drill pod approaches the drill guide, a kick plate secured to the drill pod strikes the striker pod of the palm lock driving it upwardly into its unlocked position. In this position, the extensions 58 clear the retaining arms. Thereafter, the drill pod proceeds by the drill guide simply knocking it out ot the way as it goes by. The retaining arms and inserts simply spread apart to allow the drill steel to be released. When the palm lock is kicked to its unlocked position, it is latched in that position by the spring plunger assembly so that the palm lock cannot drift into the locking position. Also, the guide assembly is latched in the vertical position as already explained so that it remains vertical until the drill pod has passed back down past the guide assembly.

Having thus described our invention with the detail and particularity required by the Patent Laws, what is desired protected by Letters Patent is set forth in the following claims.

I claim:

1. A drill steel guide for mine roof drilling and bolting machine in which the drill pod is raised and lowered along a generally vertical track, said drill steel guide mounted relative to the vertical track spaced from the downwardmost position of the drill pod, said drillsteel guide comprising a main shaft mounted on a generally horizontal axis relative to said vertical track, a clevis body pivotally mounted to said shaft, said clevis body swingable from a generally horizontal to a generally vertical position, a stop fixed relative to said shaft to limit the downward swing of the clevis body, two retaining arms pivotally mounted to said clevis body on separate axles fixed to the clevis body, said axles being perpendicular to the main shaft and generally parallel to the drill steel when the clevis body is resting on said stop, said retaining arms together defining a drill steel guide passage for receiving the drill steel, means secured to the clevis body for biasing the retaining arms together, means to releasably latch the clevis body in vertical position, palm lock means having a shaft portion slidably journaled in said clevis body in a bore having an axis parallel to the retaining arms axles and extensions for in one position restraining both retaining arms and in another position not restraining either retaining arm.

2. The drill steel guide according to claim 1 wherein the clevis body defines upper and lower planar extensions and the lower planar extension has a longitudinal groove clear through for removing dust.

3. The drill steel guide according to claim 1 wherein the means for biasing the retaining arms are leaf springs mounted on opposite sides of the clevis body and bearing upon the retaining arms.

4. The drill steel guide according to claim 1 wherein the shaft portion of the palm lock has two axially spaced annular grooves and further comprising a spring bias plunger guided by the clevis body, said plunger engaging one groove to latch the palm lock in the restraining position and the other groove to latch the palm lock in the nonrestraining position.

* * * * *